US005181843A

United States Patent [19]

Hekman et al.

[11] Patent Number: 5,181,843

[45] Date of Patent: Jan. 26, 1993

[54] INTERNALLY CONSTRAINED VANE COMPRESSOR

[75] Inventors: Edward W. Hekman, Alto; Frederick A. Hekman, Grand Rapids, both of Mich.

[73] Assignee: Autocam Corporation, Kentwood, Mich.

[21] Appl. No.: 820,525

[22] Filed: Jan. 14, 1992

[51] Int. Cl.[5] ..... F04C 18/344; F04C 27/00

[52] U.S. Cl. ..... 418/1; 418/125; 418/150; 418/257; 418/265

[58] Field of Search ..... 418/1, 125, 150, 257, 418/264, 265

[56] References Cited

U.S. PATENT DOCUMENTS

| | | | |
|---|---|---|---|
| 118,993 | 9/1871 | Wentworth . | |
| 475,301 | 5/1892 | Crowell . | |
| 1,316,855 | 9/1919 | Olson | 418/265 |
| 1,437,706 | 12/1922 | Beardslee | 418/265 |
| 2,137,708 | 11/1938 | Wilson et al. | 418/265 |
| 2,312,961 | 3/1943 | Cowherd | 418/265 |
| 2,443,994 | 6/1948 | Scognamillo . | |
| 2,634,904 | 4/1953 | Clerc . | |
| 2,672,282 | 3/1954 | Novas . | |
| 3,053,438 | 9/1962 | Meyer | 418/265 |
| 3,213,803 | 10/1965 | Meyer | 418/257 |
| 3,652,191 | 3/1972 | King et al. | 418/125 |
| 3,988,083 | 10/1976 | Shimizu et al. | 418/264 |
| 4,212,603 | 7/1980 | Smolinski | 418/257 |
| 4,299,546 | 11/1981 | Stout | 418/264 |
| 4,958,995 | 9/1990 | Sakamaki et al. | 418/152 |
| 5,087,183 | 2/1992 | Edwards | 418/265 |

FOREIGN PATENT DOCUMENTS

| | | | |
|---|---|---|---|
| 455476 | 2/1926 | Fed. Rep. of Germany | 418/265 |
| 3219757 | 12/1983 | Fed. Rep. of Germany | 418/125 |
| 551083 | 11/1956 | Italy | 418/150 |
| 313054 | 4/1930 | United Kingdom . | |

*Primary Examiner*—John J. Vrablik

*Attorney, Agent, or Firm*—Price, Heneveld, Cooper, DeWitt & Litton

[57] ABSTRACT

The present invention relates to an internally constrained vane rotary compressor employing a floating carrier ring, containing a plurality of non-continuous cam surfaces to guide a corresponding plurality of vanes about the interior of a stator, resulting in improved compressor performance. The invention features a triple roller assembly operating in conjunction with the carrier ring to both guide and constrain each vane. In addition, the invention describes a method for increasing the operating efficiency in rotary vane compressors.

63 Claims, 7 Drawing Sheets

INTERNALLY CONSTRAINED VANE COMPRESSOR

BACKGROUND OF THE INVENTION

The present invention relates to constrained vane rotary compressors. Machines of this type are typically comprised of a rotor mounted within a cylindrical stator, the mounting being such that the rotor axis is offset from the cylindrical axis of the stator. The rotor contains a plurality of slideable vanes such that the vanes may move radially with respect to the rotor axis. As the vanes rotate within the stator, they are guided such that their distal ends come close to, but do not physically engage the interior surface of the cylindrical wall of the stator. Typically, cam tracks are formed or placed in the end walls of the stator which guide the rotating vanes by means of rollers or cam followers residing in the cam tracks. The two opposing cam tracks, each situated in a stator end wall, restrain the vanes from physically contacting the interior stator wall. Such an arrangement in conjunction with an offset rotor allows the machine to operate as either a compressor or expander as the particular application necessitates. When the machine operates as a compressor, regions of varying pressure are formed between the periphery of the rotor and the stator interior wall. Regions of lowest pressure exist near the compressor's inlet port, and highest pressure regions formed near an outlet port.

There are several disadvantages in providing cam tracks in end walls of the stator. The first is that by forming tracks in the end walls, the seal between the lateral edges of the vanes and the end walls of the stator is interrupted, making it possible for gas to pass from a high pressure region on one side of a vane to a lower pressure region on the other side of the vane, by leaking past the vane through the cam tracks. In addition, the cam tracks erode the sealing area between the rotor and the end walls and allow leakage. Such leakage decreases compressor efficiency.

Another disadvantage stems from the large number of bearing or contacting surfaces between cam tracks and numerous cam followers. The cam follower may comprise a rolling element mounted on a respective vane via a stub axle. The rolling element contacts a cam surface residing in a cam track. Each vane typically contains two cam followers, each situated on an opposing side of a vane, and each residing within one of the cam tracks in the end walls of the stator. The surface that the rolling element may contact, a race, may either be stationary or rotatable with respect to the stator housing. In either situation a large number of bearing or contacting surfaces results. This is evident by noting that with each vane there are at least two bearing assemblies, one on each stub axle affixed to a rolling element. Additionally, if the cam track has a rotating race the quantity of bearing surfaces further increases. The large quantity of bearing assemblies required in machines of the present type result in added complexity in the manufacture of such machines and greater opportunity for mechanical failure.

SUMMARY OF THE INVENTION

The present invention is an internally constrained rotary vane compressor in which a freely rotatable carrier ring in the rotor interior constrains and guides a plurality of rotating vanes about the interior of the compressor. By constraining the vanes from the interior of the rotor, the need for cam tracks is eliminated and the resulting leakage of gas under pressure through cam tracks in the end wall is eliminated.

Seal area between regions of differing pressure within the compressor interior is increased. The geometry of the end walls is greatly simplified since the cam tracks are eliminated. The number of bearing or contacting surfaces within the compressor is reduced. And, the overall simplified geometry lowers manufacturing and assembly costs.

These and other objects, advantages and features of the invention can be more fully understood and appreciated by reference to the written specification and appended drawings.

BRIEF DESCRIPTION OF THE DRAWINGS

The accompanying drawings illustrate the internally constrained rotary vane compressor of the present invention.

DESCRIPTION OF THE PREFERRED EMBODIMENT

Figure 1:
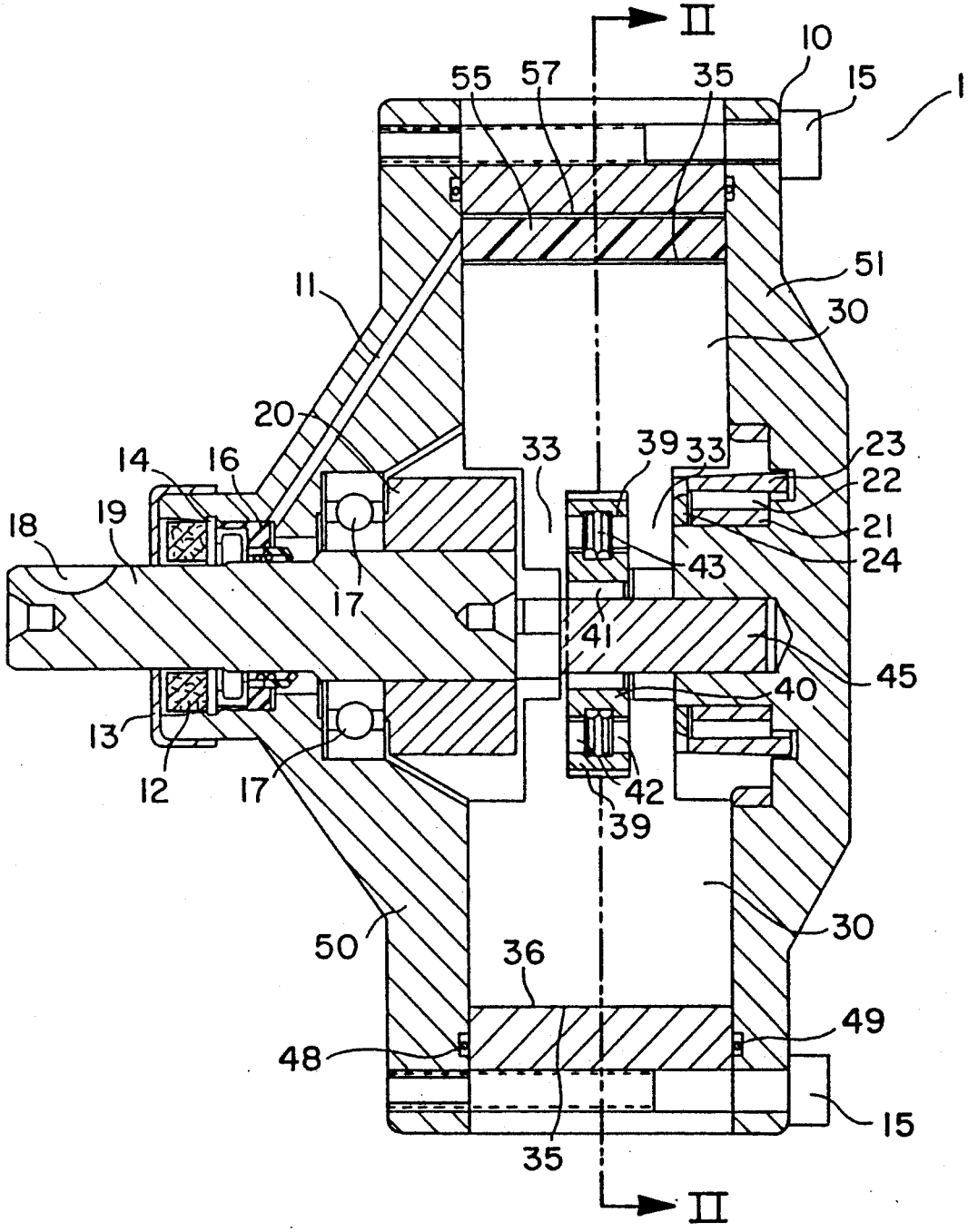
FIG. 1 is a sectional view of the present invention taken on the line I—I illustrated in FIG. 2.
Figure 2:
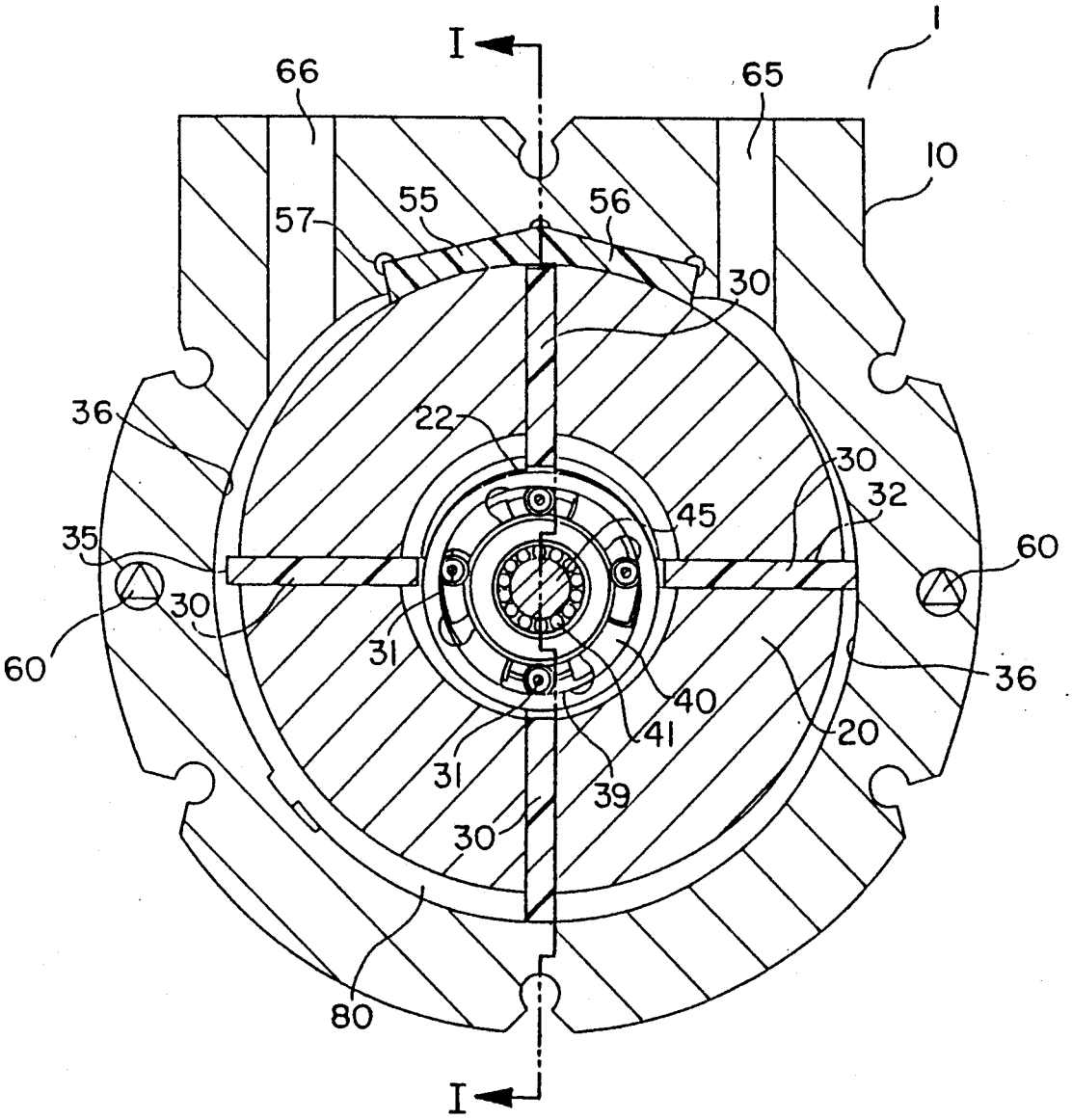
FIG. 2 is a sectional view of the present invention taken on the line II—II illustrated in FIG. 1.

In the preferred embodiment, constrained vane rotary compressor 1 has a stator 10 with attached front and rear end walls 50 and 51 (FIGS. 1 and 2). Stator 10 has a substantially cylindrical wall 36 and houses rotatable drive shaft 19 and rotor 20 having a hollow interior and a plurality of radial vane slots 32. Rotor 20 is connected to and driven by one end of drive shaft 19. The second end of drive shaft 19 extends outward from stator 10 through front end wall 50 for attachment to a rotary power source. A plurality of vanes 30 each slideably reside in a vane slot 32 and are hingedly connected to freely rotatable carrier ring 40 by triple roller assembly 42, 43 and vane pin 31. Carrier ring 40 is positioned about a projecting end of stationary carrier shaft 45 mounted in rear end wall 51, projecting inwards towards rotor 20.

Stator 10 is substantially cylindrical, having a hollow interior circumscribed by circumferential wall 36. The materials of construction for stator 10 may include steel, cast iron, brass, aluminum and suitable types of plastic. The specific material selected will depend on the application. The selection of materials of construction for the various components of the present invention are of course dictated by concerns such as durability, weight, and cost. An additional factor is the coefficient of thermal expansion. Materials having the same or similar coefficients are preferable to ensure that thermal expansion of components occurs at approximately the same rate. Provided in stator 10 are outlet port 65 and inlet port 66 extending through circumferential wall 36 providing access to the stator interior for entering and exiting gases or vapors.

Stator inserts 55 and 56 are provided to improve the durability of the interface between rotor 20 and stator circumferential interior wall 36. Galling or scoring of the wall occurs when solid particles such as dirt become trapped between the moving rotor surface and the stator wall. Stator inserts 55 and 56 function to provide a wear resistant, low friction surface, such that small solid particles which would otherwise tend to score the stator and rotor surfaces at the interface region instead merely pass over or become embedded in the insert material. Stator inserts 55 and 56 are affixed to stator interior wall 36 by compressing them into a channel having a dovetail-like cross section in stator wall 36. Passages 57 are then filled with a filler to prevent passage of gas or vapor from one side of the seal to the other. Such filler may be epoxy, although other materials may be suitable.

Desired characteristics of the insert material include durability, sufficient lubricity, strength, and a coefficient of thermal expansion similar to the main material of construction of stator 10. Where stator 10 is aluminum, a poly amide-imide polymeric material sold by AMOCO as TORLON TM 4301 works well. Where stator 10 is of cast iron, inserts 55 and 56 may not be required.

Front and rear end walls 50 and 51 are secured to stator circumferential wall 36 by stator housing bolts 15 at numerous locations around the stator perimeter. Dowel locating pins 60 may be utilized for aligning front and rear end walls 50 and 51 with stator 10. Pins 60 extend through stator circumferential wall 36 and into end walls 50 and 51. A proper seal between the stator interior and the outside environment is maintained by utilizing front and rear O-rings, 48 and 49 respectively, at the interface of stator 10 and respective end wall. Oil passageway 11 is provided in front end wall 50 to allow delivery of lubricating agent to roller bearing 17 and shaft seal 16.

Figure 3:
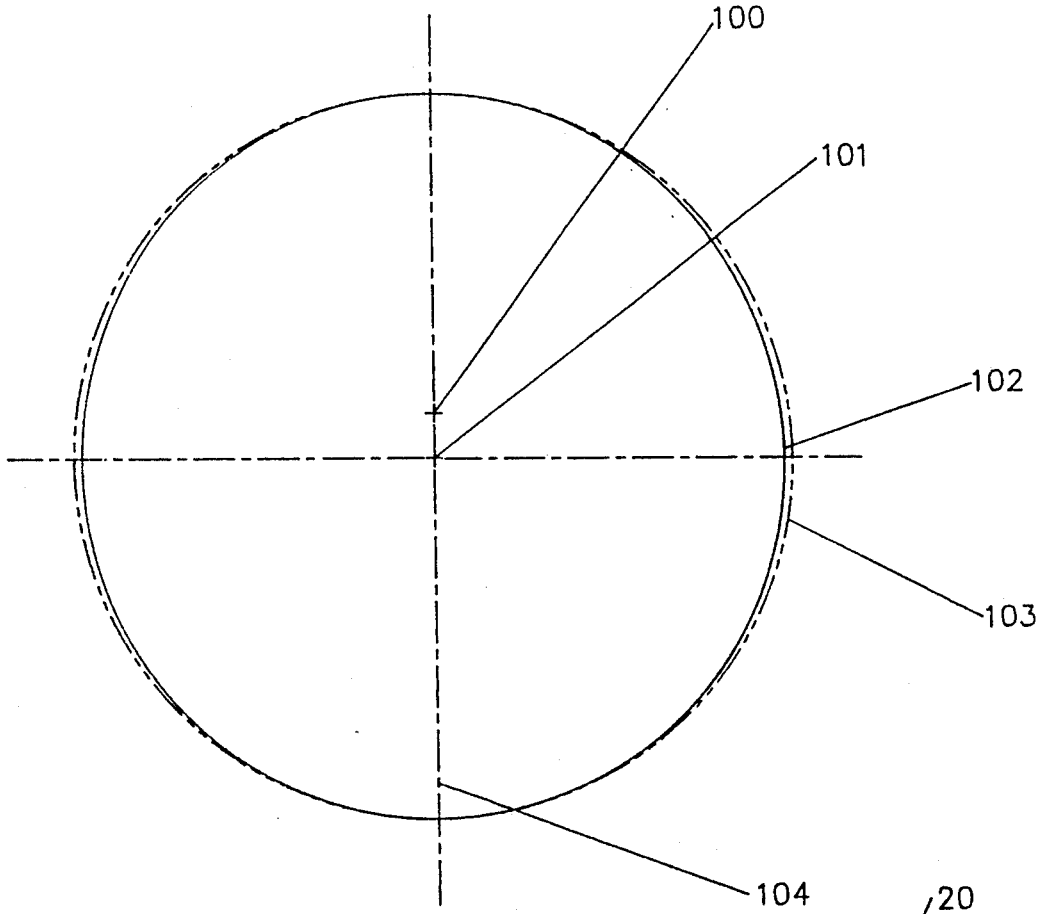
FIG. 3 illustrates the geometry of the stator interior and vane tip path.
Figure 4:
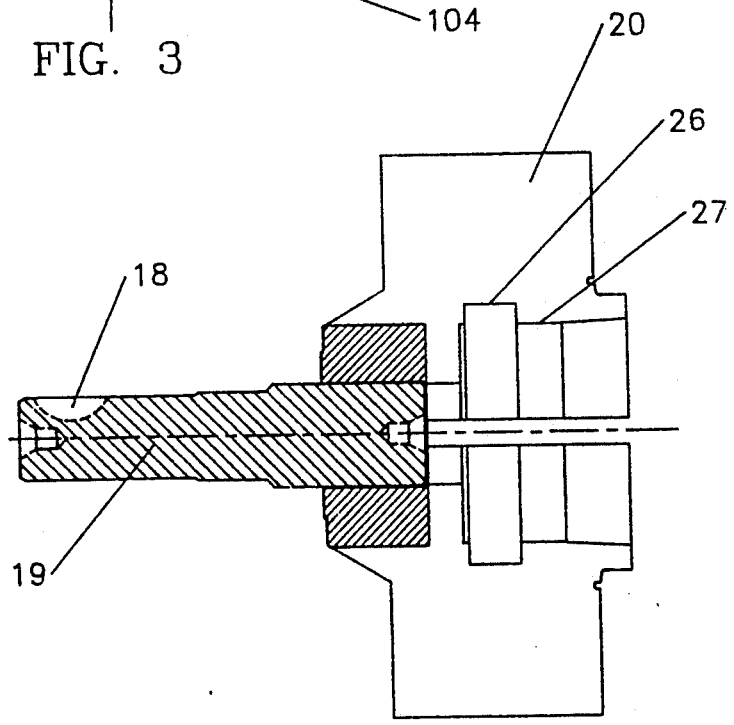
FIG. 4 is a sectional view of the rotor taken on the line IV—IV illustrated in FIG. 5.
Figure 5:
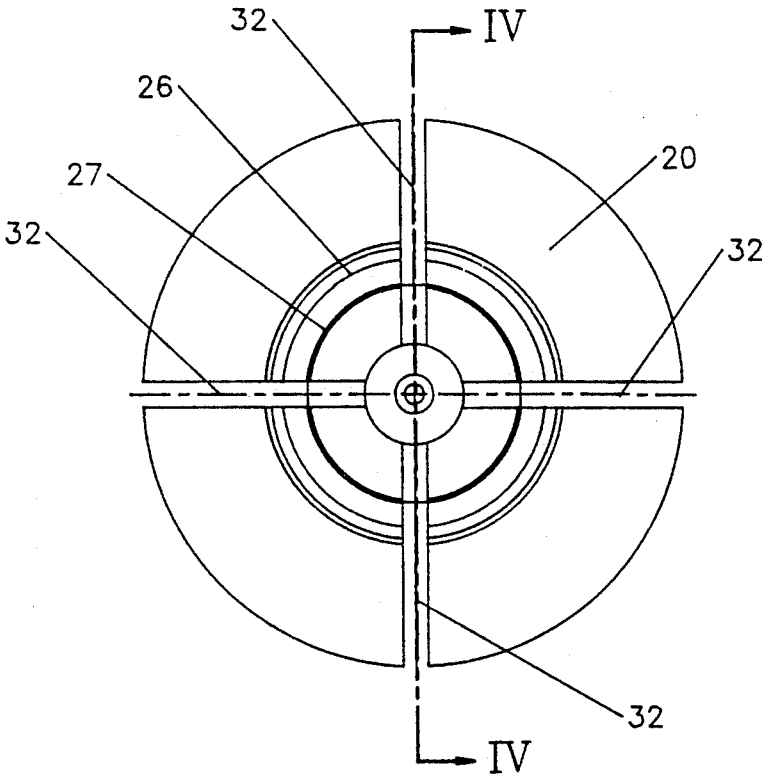
FIG. 5 is a side elevational view of the rotor.

Rotatable drive shaft 19 is positioned such that it rotates on an axis passing through point 100 in FIG. 3, offset from the axial centerline 101 of stator 10. That is, the axis of rotation of drive shaft 19 and rotor 20 is parallel to, but does not coincide with the axial centerline of stator 10. Rotor 20 is attached to drive shaft 19 and positioned within the interior of stator 10. Rotor 20 is formed such that it has a substantially hollow interior and a plurality of radial vane slots 32 (FIG. 5). Vane slots 32 are radially arranged about the center of rotor 20 and are each of sufficient dimensions to accommodate vane 30 (FIG. 2). Drive shaft 19 is rotatably secured in drive shaft roller bearing 17 positioned in front end wall 50 accessible from the interior of stator 10. The shaft/rotor assembly (FIG. 4) is also journaled in rear end wall 51 in an assembly of rotor bearing inner race 21, rotor bearing 22 which may be of the caged needle bearing type, rotor bearing outer race 23, and retaining washer 24. A ball bearing set could be substituted for the rotor roller bearing set as the application necessitates.

Carrier ring 40, plurality of vanes 30, and triple roller assembly 42, 43 including vane pin 31 rotate about stationary carrier shaft 45 via carrier bearing 41 such that the axis of rotation of the assembly coincides with the axial centerline 101 of stator 10 (FIG. 3).

Carrier ring 40 is positioned within the interior of rotor 20 and oriented to allow hingedly connected vanes 30 to extend radially outward in vane slots 32 (FIGS. 2 and 5). Upon application of rotary power to drive shaft 19; rotor 20, plurality of vanes 30, triple roller assembly 42, 43, 31 and carrier ring 40 rotate within the stator interior. Since rotor 20 and carrier ring 40 have different axes of rotation, and as the vanes are constrained by carrier ring 40 residing within the interior of rotor 20, the vanes slideably reciprocate within radial vane slots 32 with respect to rotor 20 and the vane tips trace a nearly circular path 102 (FIG. 3).

Drive shaft seal 16 (FIG. 1) is provided in front end wall 50 through which drive shaft 19 extends. Drive shaft seal 16 is located on the exterior side of drive shaft roller bearing 17 (relative to the stator interior), surrounding the outer periphery of drive shaft 19. Seal 16 is provided to prevent leakage of the refrigerant from the compressor. Residing in an annular cavity formed between front end wall 50 and drive shaft 19 is felt wick 12 which further retains lubricating agent which may seep past drive shaft seal 16. Seal cover 13 is secured to the exterior side of front end wall 50 through which drive shaft 19 extends and covers the contents of the annular cavity in which reside felt wick 12, retaining ring 14, and drive shaft seal 16. Drive shaft 19 includes keyway 18 for mating with an external rotary power source.

Carrier shaft 45 is a stationary shaft extending from rear end wall 51 to the interior of stator 10. Carrier shaft 45 is secured to rear end wall 51 by pressing the shaft into the end wall. The axial centerline of carrier shaft 45 coincides with the cylindrical axis 101 of stator 10 (FIG. 3). Carrier shaft 45 extends into the interior of stator 10 to engage and guide carrier bearing 41 and thereby to constrain carrier 40 and attached vanes 30. Carrier 40 is located at the lateral midpoint of vane 30.

The profile geometry of the stator interior circumferential wall 36 closely matches the vane tip path 102 and is "noncircular asymmetric", having only one axis of symmetry, vertical line 104 (FIG. 3). The amount of offset between axis 100 of rotor 20 and cylindrical axis 101 of stator 10 is defined by a vector originating from carrier center 101 (which coincides with the stator cylindrical axis) to rotor center 100. The amount of offset determines the shape of the noncircular, asymmetric path the distal tips of the vanes trace as they rotate within the stator interior. FIG. 3 illustrates vane path 102 which results from offset defined by vector 101, 100, as compared to a true circle 103 having its center at 101.

The following equations define the noncircular asymmetric path 102 the distal vane tips 35 trace as they rotate within the interior of stator 10.

$$X=[(r\cdot\cos(a)-X_r)(1+V/((r\cdot\cos(a)-X_r)^2+(r\cdot\sin(a)-Y_r)^2)^{1/2})]+(X_r-X_c)$$

$$Y=[(r\cdot\sin(a)-Y_r)(1+V/((r\cdot\cos(a)-X_r)^2+(r\cdot\sin(a)-Y_r)^2)^{\frac{1}{2}})]+(Y_r-Y_c)$$

Where r = the radial distance from carrier center 101 to vane pin 31 center;

v = the linear distance from vane pin 31 center to distal vane tip 35;

a = the angle of rotation of the vane pin as it rotates about the carrier center, expressed from 0°-360° (the 0° radial is conventionally the horizontal radial to the right of center);

$X_r$, $Y_r$ = the cartesian coordinates for rotor center 100;

$X_c$, $Y_c$ = the cartesian coordinates for carrier center 101; and

X,Y = the cartesian coordinates of the location of the distal tip of a rotating vane at angle of rotation a.

In order to achieve close tolerances between distal vane tip 35 and the interior of stator circumferential wall 36 at all points throughout a vane's rotation, the profile of the interior of wall 36 should match the shape of vane path 102. The above equations enable the geometry of interior stator wall 36 to be defined and thus accurately machined to obtain the desired profile.

Rotor 20 is typically formed by machining blank material stock to desired dimensions. Rotor 20 is typically formed by machining a blank which has drive shaft 19 pressed into rotor 20 to a predetermined depth. Rotor 20 must provide a carrier clearance hole 27 (FIGS. 4 and 5) to allow insertion of carrier ring 40, roller assembly 42, 43, and vanes 30 into rotor 20, during assembly of the present invention. Upon completed assembly, carrier ring 40 resides within carrier recess 26. Rotor 20 may be constructed of a variety of materials such as steel, cast iron, aluminum, hard coated aluminum, brass or suitable plastics. As with stator 10, the specific material selected will be a function of application.

Figure 6:
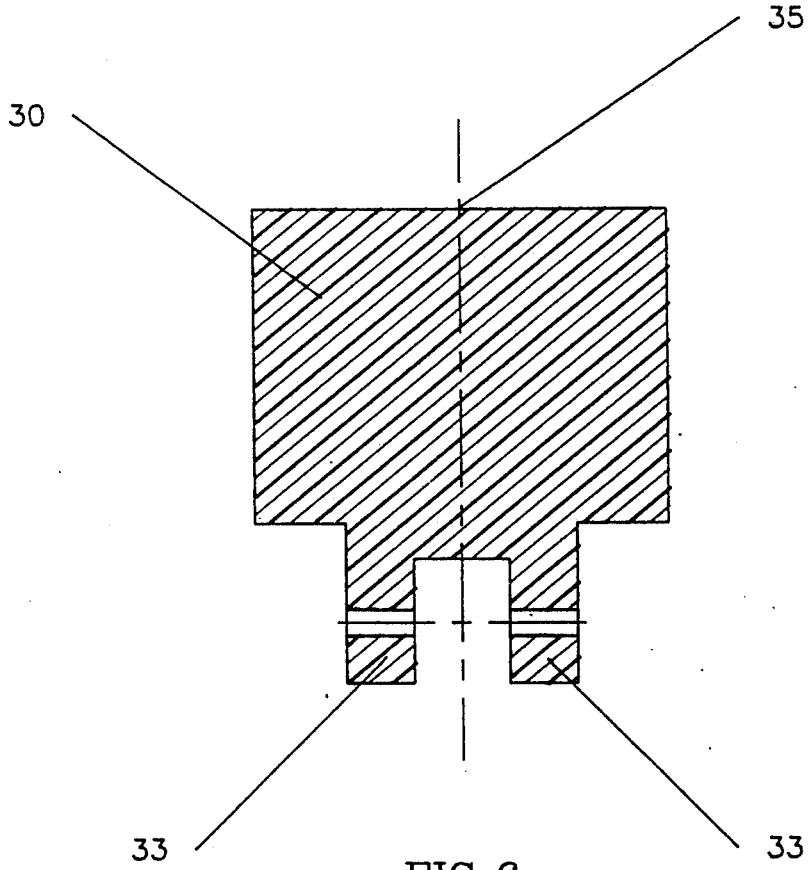
FIG. 6 is a sectional view of a vane.

FIG. 6 illustrates a typical vane 30 having vane tongues 33 and distal tip 35. The number of vanes that may be employed in compressors of the present invention depends upon diameter of carrier ring 40 and amount of offset utilized in the unit. The preferred number of vanes is four but may range less or more in number if the application so requires. Materials of construction for vane 30 may be selected from those known in the art, but preferred is TORLON TM. Desired characteristics of the vane material selected include durability, sufficient lubricity and strength, and a coefficient of thermal expansion similar to the main material of construction. Steel vanes may be utilized, most typically in units of all steel or cast iron construction.

The present invention eliminates the requirement for vane springs (used in some previous designs to bias the vanes outward) by utilizing a triple roller assembly (FIG. 7) in conjunction with a floating, non-continuous cam surface to engage the vanes with the stator interior. This allows a simpler operation and facilitates ease of maintenance. Such simplification reduces the complexity of the assembled compressor and hence, material costs and labor.

Figure 7:
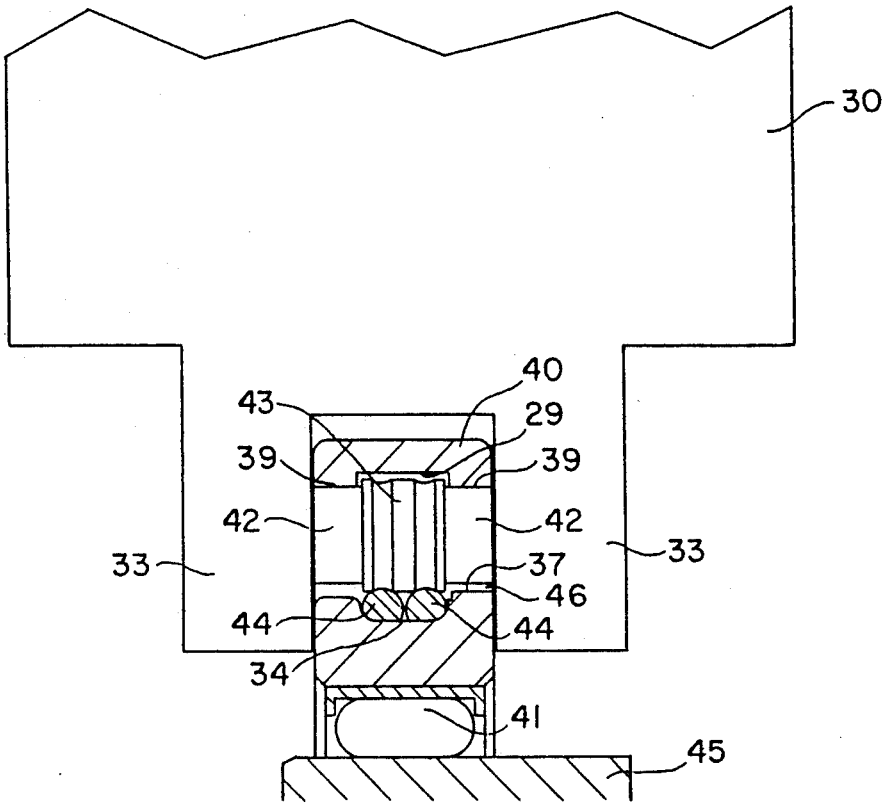
FIG. 7 is a detailed cross-sectional view of the carrier ring, triple roller assembly, and vane configuration taken along plane VII—VII of FIG. 8.

Carrier ring 40 rotates via carrier bearing 41 on stationary carrier shaft 45. Vane 30 is attached to carrier ring 40 by vane pin 31 (FIGS. 1 and 8) extending through triple roller assembly 42, 43 and one of a plurality of arcuate passages 46 (FIG. 8) in carrier ring 40. Vane pin 31 extends through tongue 33 of vane 30, first outer roller 42, inner roller 43, second outer roller 42, and second tongue 33 of vane 30 (FIG. 7). Cam surface 39, located on the outer wall of carrier passage 46, guides the vanes as they rotate within the interior of stator 0. Such guidance is performed via outer rollers 42 contacting cam surface 39 on outer wall of arcuate carrier passage 46. During compressor operation, depending upon the pressure at the interior of rotor 20, the pressure between stator wall 36 and outer periphery of rotor 20 may be sufficient to drive a vane radially inwards towards rotor center 100, thus allowing leakage of gas or vapor from one side of a vane having a higher pressure to the other, lower pressure, side. To prevent this, the present invention uses inner roller 43 to preload the outer rollers 42 against cam surface 39. One method to accomplish this, shown in FIG. 7, uses two O-rings 44 positioned between the interior wall 37 of carrier passage 46 and inner roller 43. The O-rings 44 are compressed by roller 43 and provide a elastic force outward to resist inward movement of vane 30. A variety of other inner roller and inner cam surface arrangements can be envisioned within the scope of the current invention. For example, if a more rigid assembly were required the elastic O-rings 44 could be replaced by a hardened steel internal track similar to external cam surface 39, and the curved inner roller 43 could be replaced by a flat roller similar to outer rollers 42.

Figure 8:
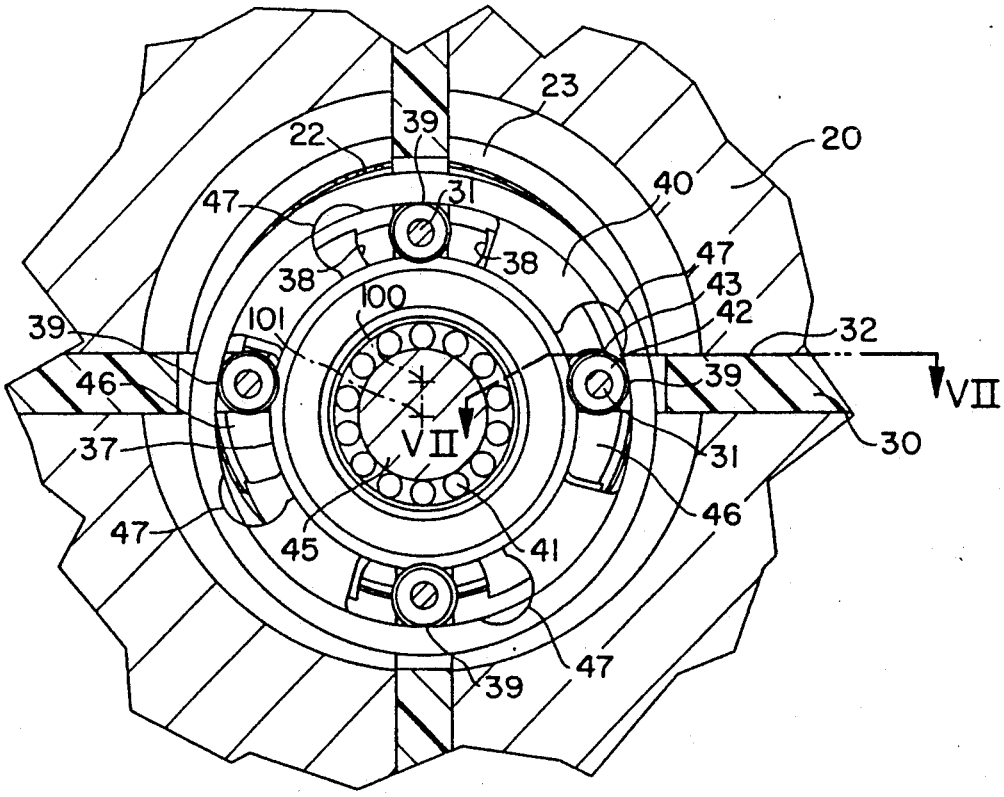
FIG. 8 is a side elevational, partly cross-sectional view of the carrier ring when assembled in the present invention.

FIG. 8 illustrates the floating, non-continuous carrier ring of the present invention. Carrier ring 40 is said to be "floating" in that it is not fixed to carrier shaft 45, but rather may freely rotate via carrier bearing 41 along with rotor 20 and plurality of vanes 30 upon application of rotary power to drive shaft 19. Carrier ring 40 is positioned such that its axis of rotation coincides and is parallel to the cylindrical axis of stator 10.

It is important that carrier ring 40 be freely rotatable within stator 10. Of necessity, carrier ring 40 rotates at approximately the same speed as rotor 20, but small angular displacements of the carrier ring relative to the rotor are allowed since the carrier ring 40 and rotor 20 are not directly linked. Reduced wear and friction are achieved by cam surfaces 39 rotating within the stator interior at substantially the same rate as rotor 20 and a corresponding vane 30 and triple roller assembly 42, 43. The extent of movement between a triple roller assembly 42, 43 and cam surface 39 is greatly reduced thereby decreasing wear and friction at the interface of the above components. Secondly, initial tolerances between the assembled components are better maintained over the life of the compressor due to the reduced wear.

There is a corresponding arcuate passage 46 and cam surface 39 for each vane 30 and triple roller assembly 42, 43. It is preferable that there be a separate arcuate passage 46 for each associated triple roller assembly 42, 43, rather than one continuous circular passage in which rollers 42 and 43 travel. In addition to simplifying construction, such a non-continuous arrangement assists in causing carrier ring 40 to rotate at the same speed as rotor 20. As each triple roller assembly 42, 43 comes to the end of its associated passage 46, it forces carrier ring 40 to rotate, thus keeping up with the rotation of rotor 20. Each passage 46 is formed by a carrier passage interior wall 37, two carrier passage end walls 38, and a carrier passage outer wall which also functions as cam surface 39 for a particular vane's roller assembly 42, 43 (FIG. 8). Each roller assembly contacts the cam surface outer wall of its respective arcuate passage, thereby constraining and guiding the radial movement of each vane. As each vane and triple roller assembly has its own passage, in the case of a rotor vane assembly consisting of four vanes, the carrier ring of the present invention would contain a total of four separate arcuate passages 46.

Figure 9:
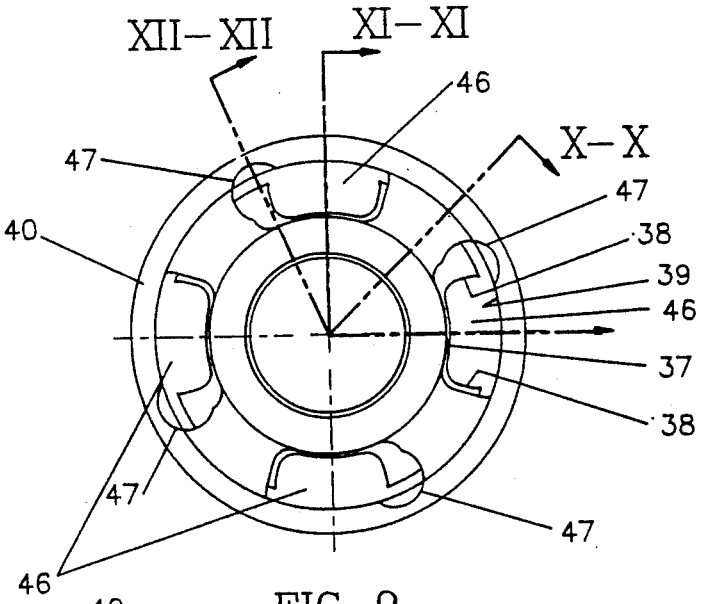
FIG. 9 is a front side elevation of the carrier ring.

The construction of the carrier ring 40 can be seen in FIGS. 9, 10, 11, 12 and 13. FIG. 9 illustrates an elevational view of the front of carrier ring 40 having four arcuate passages 46. Each passage 46 is equidistant from adjacent passages. For each passage 46, there is provided an inner roller access slot 47 which allows insertion of inner roller 43 into passage 46 during assembly.

Each arcuate passage 46 in carrier ring 40 is formed such that the center point of the arcs forming passage interior wall 37 and outer wall or cam surface 39, coincides with the center and axis of rotation of carrier ring 40. The radial distance between interior wall 37 and cam surface 39 must be slightly greater than the diameter of outer roller 42. Passage end walls 38 are formed at opposite ends of passage 46. Each passage end wall 38 is substantially a half-circle formed about a center point lying midway between the radial distance between interior wall 37 and cam surface 39. The curvilinear distance between the two center points of passage end walls 38, along an arc midway between interior wall 37 and cam surface 39, should be such that the linear distance between the center points is slightly greater than twice the offset distance between the axis of rotation of the rotor and the cylindrical axis of the stator.

Figure 11:
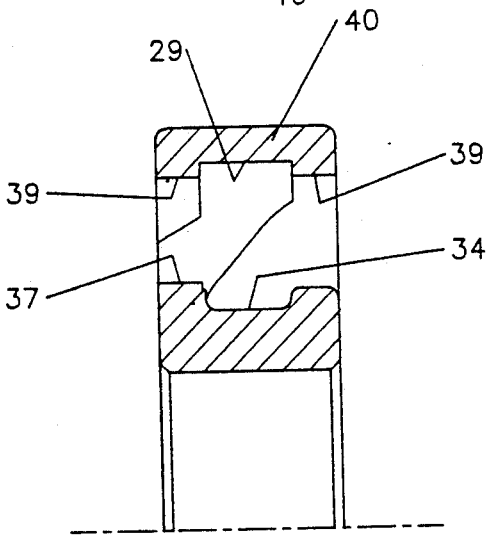
FIG. 11 is a sectional view of the carrier ring taken on the line XI—XI illustrated in FIG. 9.
Figure 12:
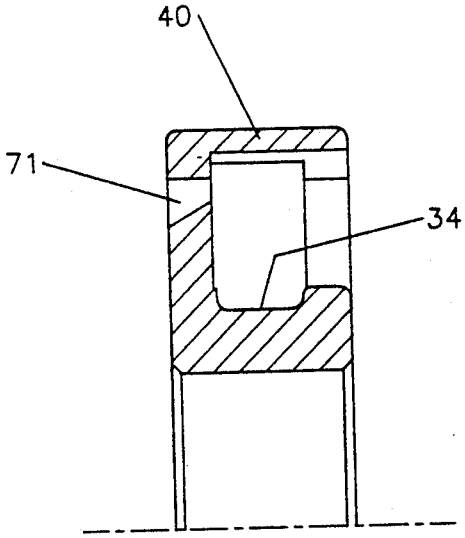
FIG. 12 is a sectional view of the carrier ring taken on the line XII—XII illustrated in FIG. 9.
Figure 10:
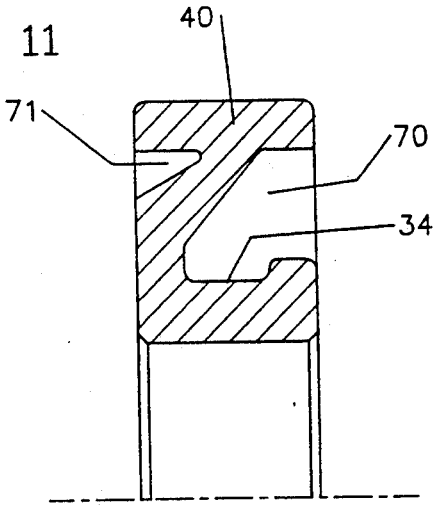
FIG. 10 is a sectional view of the carrier ring taken on the line X—X illustrated in FIG. 9.
Figure 13:
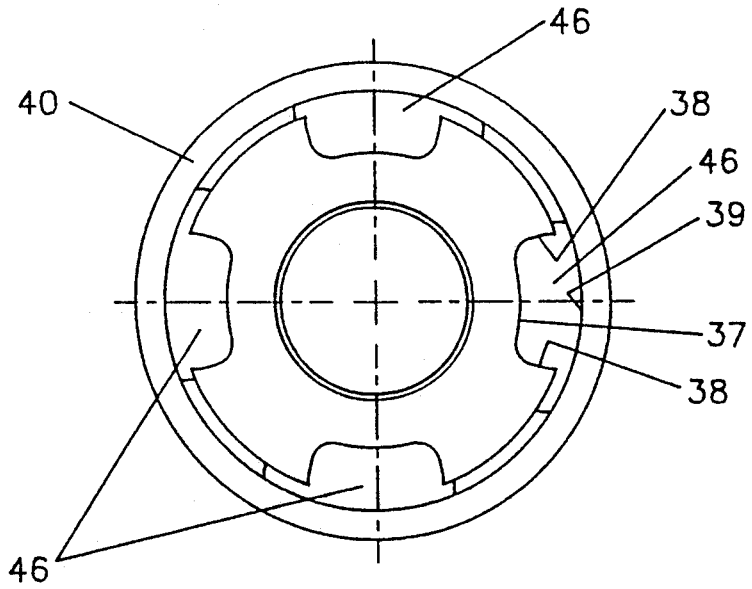
FIG. 13 is a rear side elevation of the carrier ring.

FIG. 10 details a cross section of carrier ring 40 taken along line X—X shown in FIG. 9. This cross section illustrates annular channel 70 formed on the front side of carrier ring 40, and V-shaped channel 71 on the rear of ring 40. Both channels extend around their respective sides of carrier ring 40, about a common center point coinciding with the axis of rotation of carrier ring 40. Portions of the outer walls of channels 70 and 71 become cam surfaces 39 in those regions where the channels pass through passages 46. The reason for forming channels 70 and 71 is that a greater degree of accuracy in machining is obtained when forming continuous surfaces as opposed to non-continuous ones. FIGS. 11 and 12 illustrate cross sections of carrier ring 40 taken along lines XI—XI and XII—XII respectively, shown in FIG. 9. FIG. 13 shows the rear elevational view of carrier ring 40.

FIG. 11 illustrates carrier passage O-ring depression 34 provided in passage interior wall 37. The channel-like recessed area comprising O-ring depression 34 provides a seat for O-rings 44 situated in the inner periphery of carrier ring 40. O-ring depression 34 is formed by machining a channel-like recession 34 in the interior wall of annular channel 70. The depth of O-ring depression 34 may vary depending upon the application. Typically, the depth of O-ring depression 34 relative to carrier passage interior wall 37 should be such that when O-rings 44 are situated in depression 34, inner roller 43 will contact them and outer rollers 42 will affirmatively contact cam surface 39. Central clearance channel 29 is provided between cam surfaces 39. Clearance channel 29 extends radially outward from the axis of rotation of carrier ring 40 and provides clearance for inner roller 43 via a recessed channel. The depth of clearance channel 29 relative to cam surface 39 should be such that inner roller 43, when biased radially outwards by O-ring 44, will not contact carrier ring 40.

ALTERNATIVE EMBODIMENT CARRIER

Figure 14:
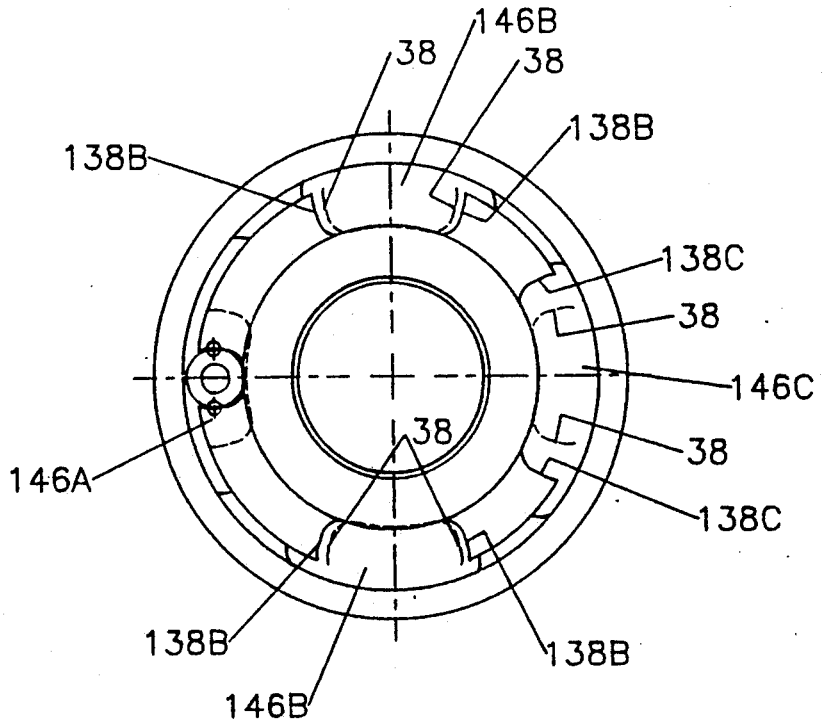
FIG. 14 is a rear side elevation of an alternative carrier ring design.

Alternative embodiment carrier 140 (FIG. 14) is similar to carrier 40, but one of its arcuate passages 146A is shortened in length such that it becomes a pin connection. One of its associated outer rollers 42 is trapped and held against tangential motion relative to carrier 140. The two adjacent arcuate passages 146B are extended in length to accommodate the greater travel of their associated roller assemblies relative to the roller assembly pinned in opening 146A. The positions of end walls 138B of passages 146B relative to the positions of end walls 38 of passages 46 are indicated on FIG. 14. The end walls 138C of opposite passage 146C are similarly extended, but are extended approximately twice the distance of end walls 138B.

By thus pinning one of the roller assemblies against tangential motion relative to carrier 140, a substantial reduction in vibration, noise and wear and tear is achieved. At the present time, this is believed to be the preferred mode for practicing the invention.

OPERATION

A drive source, typically an electric motor is attached to drive shaft 19 by a key inserted into keyway 18. Upon application of torque to drive shaft 19, rotor 20, vanes 30, and carrier ring 40 rotate within the stator interior. Referring to FIG. 2, as the rotor and vane assembly revolves in a counterclockwise direction, inlet port 66 allows vapor or gas to be drawn into the relatively low pressure region 80 within the unit's interior. Vaned compartments of variable volume are formed by two adjacent vanes 30, front and rear end walls 50 and 51, rotor 20, and stator circumferential wall 36. The vaned compartments decrease in volume during one cycle of rotation from inlet port 66 to outlet port 65, thus performing the compression operation. Vanes 30 are radially constrained by carrier ring 40 rotating about the axis of carrier shaft 45 so as rotor 20 revolves about its axis of rotation, different from that of carrier shaft 45, the vanes slideably reciprocate in a radial direction within their respective vane slots 32.

As the rotor, vanes, and carrier ring rotate about the interior of the stator, distal tips 35 of vanes 30 are kept in very close proximity to stator wall 36 to effectively seal the vaned compartments from one another such that efficient operation of the unit is achieved. Otherwise, gases undergoing compression may escape to other regions within the stator, thereby lowering the overall efficiency of the compressor. In normal operation, the interior of wall 36 of the stator will become coated with lubricating oil which will act to seal the gap between vane tip 35 and interior wall 36. In the preferred embodiment the distance between vane tip 35 and stator wall 36 is approximately 0.050 mm. To perform such engaging, vanes 30 are guided by cam surfaces 39 located in carrier ring 40.

Through the use of the above mentioned features an increased seal area between low and high pressure regions within a rotary vane compressor is achieved. In addition to increasing the compressor's efficiency, the increased seal area enables the compressor to be downsized more readily than other constrained rotary vane compressors. Furthermore, the increased seal area allows use of a wider RPM operating range as compared to other constrained rotary vane compressors known in the art.

Of course it is understood that various changes and alterations can be made to the preferred embodiment without departing from the spirit and broader aspects of the invention as set forth in the appended claims.

The aspects of the invention in which an exclusive property of privilege is claimed are defined as follows:

1. An internally contraining vane rotary compressor comprising:

a stator having a hollow interior, circumferential interior wall, two end walls, and two openings through said circumferential interior wall defining an inlet to and an outlet from said stator interior;

a rotatable rotor having a hollow interior, said rotor eccentrically mounted within said stator such that the axis of rotation of said rotor is parallel to and offset from the axis of said stator;

a rotatable drive shaft passing through one of said end walls of said stator and projecting into said stator interior, said rotor affixed to said drive shaft for rotation therewith;

a fixed carrier shaft extending from one of said end walls towards said stator interior such that the cylindrical axis of said carrier shaft coincides with said axis of said stator;

a carrier ring residing within said rotor interior, said carrier being rotatably mounted on and rotatable about said carrier shaft; and a plurality of vanes radially slideable within said rotor, said vanes being hingedly connected to said carrier, each of said vanes including a pair of tongues embracing either side of said carrier and means serving as a pin extending between said tongues and through an aperture in said carrier, there being an aperture in said carrier for each said vane and said vane pin means, whereby upon rotation of said rotor, said carrier constrains and guides said vanes such that their distal ends come close to, but do not engage the surface of said circumferential interior wall of said stator; at least one of said apertures being sufficiently small relative to its respective one of said pin means that rotation of said rotor and said vanes causes said carrier to rotate with said rotor, the engagement of said pin means and said at least one aperture also preventing radial outward movement of said vane; at least each of the remainder of said apertures comprising an arcuate passage with an arcuate interior wall positioned radially towards said carrier axis of rotation and an arcuate outer wall spaced outwardly therefrom, said interior and exterior arcuate walls being joined at their ends by arcuate passage end walls, the distance between said end walls being sufficiently short that said arcuate passages do not extend continuously from one passage to the next adjacent passage, and being sufficiently long to allow a degree of tangential motion in the arcuate passage, while said outer arcuate passage wall effectively prevents radial movement of the vane outward from the carrier center of rotation.

2. The apparatus of claim 1 in which said pin means on each said vane engaging its adjacent arcuate passage comprises a multiple roller assembly comprising at least two rollers rotatably mounted about a common axle, said axle being secured to and extending between said vane tongues, such that at least one roller will contact said arcuate outer wall to effectively constrain the vane from outward radial motion, while inward radial motion is constrained by at least one other roller contacting said arcuate interior wall.

3. The apparatus of claim 2 which includes a resilient member lining said arcuate interior wall of said arcuate passage which tends to bias said multiple roller assembly into engagement with said arcuate outer wall.

4. An internally constrained vane rotary compressor in accordance with claim 3, wherein said carrier contains an annular, continuous channel formed on one side of said carrier, said annular channel having a center point coinciding with said axis of rotation of said carrier, said annular channel formed such that the interior wall of said annular channel nearest to said carrier axis of rotation coincides at least in part with each said arcuate interior wall of said arcuate passages.

5. An internally constrained vane rotary compressor in accordance with claim 4 ,wherein said annular channel formed on one side of said carrier has an exterior wall, located furthest from said carrier axis of rotation, also coinciding at least in part with each said arcuate outer wall of said arcuate passages.

6. An internally constrained vane rotary compressor in accordance with claim 5, wherein said carrier contains at least one O-ring residing along said interior wall of said annular channel, said O-ring comprising said resilient member.

7. An internally constrained vane rotary compressor in accordance with claim 6, wherein said interior wall of said annular channel formed in said carrier has a carrier passage O-ring depression extending radially inwards towards said axis of rotation of said carrier, said carrier passage O-ring depression providing seat area for said O-ring.

8. The internally constrained vane rotary compressor in accordance with claim 7, wherein said carrier includes an annular, continuous channel formed on the other side of said carrier, said second annular channel having a center point coinciding with said axis of rotation of said carrier, said second annular channel formed such that the exterior wall of said second annular channel, located furthest from said carrier axis of rotation, also coincides at least in part with each said arcuate outer wall of said arcuate passages.

9. An internally constrained vane rotary compressor in accordance with claim 7, wherein the linear distance between said end walls of each said arcuate passage is about equal to twice the distance between said axis of rotation of said rotor and said cylindrical axis of said stator.

10. The apparatus of claim 1 in which said pin means on each said vane engaging its adjacent arcuate passage comprises at least one roller.

11. An internally constrained vane rotary compressor in accordance with claim 10, comprising:

an annular continuous channel formed on one side of said carrier, said annular channel having a center point coinciding with said axis of rotation of said carrier, said annular channel formed such that the interior wall of said annular channel nearest to said carrier axis of rotation coincides at lest in part with each said arcuate interior wall of said arcuate passages.

12. An internally constrained vane rotary compressor in accordance with claim 11, wherein said annular channel formed on one side of said carrier has an exterior wall, located furthest from said carrier axis of rotation, also coinciding at least in part with each said arcuate outer wall of said arcuate passages.

13. An internally constrained vane rotary compressor in accordance with claim 12, wherein said carrier contains at least one O-ring residing along said interior wall of said annular channel.

14. An internally constrained vane rotary compressor in accordance with claim 13, wherein said interior wall of said annular channel formed in said carrier has a carrier passage O-ring depression extending radially inwards towards said axis of rotation of said carrier, said carrier passage O-ring depression providing seat area for said O-ring.

15. The internally constrained vane rotary compressor in accordance with claim 14, wherein said carrier includes an annular, continuous channel formed on the other side of said carrier, said second annular channel having a center point coinciding with said axis of rotation of said carrier, said second annular channel formed such that the exterior wall of said second annular channel, located furthest from said carrier axis of rotation, also coincides at least in part with each said arcuate outer wall of said arcuate passages.

16. An internally constrained vane rotary compressor in accordance with claim 1 comprising:

an annular continuous channel formed on one side of said carrier, said annular channel having a center point coinciding with said axis of rotation of said carrier, said annular channel formed such that the interior wall of said annular channel nearest to said carrier axis of rotation coincides at lest in part with each said arcuate interior wall of said arcuate passages.

17. An internally constrained vane rotary compressor in accordance with claim 16, wherein said annular channel formed on one side of said carrier has an exterior wall, located furthest from said carrier axis of rotation, also coinciding at least in part with each said arcuate outer wall of said arcuate passages.

18. An internally constrained vane rotary compressor in accordance with claim 17, wherein said carrier contains at least one O-ring residing along said interior wall of said annular channel.

19. An internally constrained vane rotary compressor in accordance with claim 18, wherein said interior wall of said annular channel formed in said carrier has a carrier passage O-ring depression extending radially inwards towards said axis of rotation of said carrier, said carrier passage O-ring depression providing seat area for said O-ring.

20. The internally constrained vane rotary compressor in accordance with claim 19, wherein said carrier includes an annular, continuous channel formed on the other side of said carrier, said second annular channel having a center point coinciding with said axis of rotation of said carrier, said second annular channel formed such that the exterior wall of said second annular channel, located furthest from said carrier axis of rotation, also coincides at least in part with each said arcuate outer wall of said arcuate passages.

21. An internally constrained vane rotary compressor in accordance with claim 1, wherein said stator circumferential interior wall has a profile substantially matching the path formed by the distal tips of said vanes when rotated in said stator interior, said path defined by coordinates (X, Y):

$$X=[(r\cdot\cos(a)-X_r)(1+V/((r\cdot\cos(a)-X_r)^2+(r\cdot\sin(a)-Y_r)^2)^{\frac{1}{2}})]+(X_r-X_c)$$

$$Y=[(r\cdot\sin(a)-Y_r)(1+V/((r\cdot\cos(a)-X_r)^2+(r\cdot\sin(a)-Y_r)^2)^{\frac{1}{2}})]+(Y_r-Y_c)$$

where r = the radial distance from said cylindrical axis of said carrier shaft to the cylindrical axis of said vane pin;

v = the linear distance from said cylindrical axis of said vane pin to said distal tip of said vane;

a = the angle of rotation of said vane pin expressed from 0°-360°;

$X_r$, $Y_r$ = the cartesian coordinates of said axis of rotation of said rotor;

$X_c$, $Y_c$ = the cartesian coordinates of said cylindrical axis of said carrier shaft; and X,Y = the cartesian coordinates of said distal tip of said vane, at said angle of rotation a.

22. The apparatus of claim 21 in which said pin means on each said vane engaging its adjacent arcuate passage comprises at least one roller.

23. The apparatus of claim 22 in which said pin means on each said vane engaging its adjacent arcuate passage comprises a triple roller assembly comprising three rollers rotatably mounted about a common axle extending between and joined to said tongues, said arcuate interior wall being engaged by the inner roller of said triple roller assembly, said arcuate outer wall including a central clearance channel providing clearance for said inner roller and being engaged by each of the outer rollers of said triple roller assembly on either side of said inner roller and said clearance channel.

24. An internally constrained vane rotary compressor comprising:

a stator having a hollow interior, circumferential interior wall, two end walls, and two openings through said circumferential interior wall defining an inlet to and an outlet from said stator interior;

a rotatable rotor having a hollow interior, said rotor eccentrically mounted within said stator such that the axis of rotation of said rotor is parallel to and offset from the axis of said stator;

a rotatable drive shaft passing through one of said end walls of said stator and projecting into said stator interior, said rotor affixed to said drive shaft for rotation therewith;

a fixed carrier shaft extending from one of said end walls towards said stator interior such that the cylindrical axis of said carrier shaft coincides with said axis of said stator;

a carrier ring residing within said rotor interior, said carrier being freely rotatable about said carrier shaft; and a plurality of vanes radially slideable within said rotor, said vanes hingedly connected to said carrier, whereby upon rotation of said rotor, said carrier constrains and guides said vanes such hat their distal ends come close to, but do not engage the surface of said circumferential interior wall of said stator;

said hinged connection between said vanes and said carrier being defined by:

an arcuate passage extending through said carrier for each said vane; and a means of connection between each vane and its adjacent arcuate passage allowing a degree of tangential motion in the arcuate passage while effectively preventing radial movement of the vane outward from the carrier center of rotation;

said engaging means on each said vane comprising a vane pin extending from said vane into said arcuate passage; said stator circumferential interior wall having a profile substantially matching the path formed by the distal tips of said vanes when rotated in said stator interior, said path defined by coordinates (X, Y):

$$X=[(r\cdot\cos(a)-X_r)(1+V/((r\cdot\cos(a)-X_r)^2+(r\cdot\sin(a)-Y_r)^2)^{\frac{1}{2}})]+(X_r-X_c)$$

$$Y=[(r\cdot\sin(a)-Y_r)(1+V/((r\cdot\cos(a)-X_r)^2+(r\cdot\sin(a)-Y_r)^2)^{\frac{1}{2}})]+(Y_r-Y_c)$$

where r=the radial distance from said cylindrical axis of said carrier shaft to the cylindrical axis of said vane pin;

v=the linear distance from said cylindrical axis of said vane pin to said distal tip of said vane;

a=the angle of rotation of said vane pin expressed from 0°-360°;

$X_r$, $Y_r$=the cartesian coordinates of said axis of rotation of said rotor;

$X_c$, $Y_c$=the cartesian coordinates of said cylindrical axis of said carrier shaft; and X,Y=the cartesian coordinates of said distal tip of said vane, at said angle of rotation a;

said means on each said vane engaging its adjacent arcuate passage comprising a triple roller assembly comprising three rollers rotatably mounted about said vane pin, said vane pin secured to said vane; said arcuate passage comprising an arcuate interior wall positioned radially towards said carrier axis of rotation, said interior wall being engaged by the inner roller of said triple roller assembly, said arcuate passage including an arcuate outer wall, said arcuate outer wall including a central clearance channel providing clearance for said inner roller and being engaged by each of the outer rollers of said triple roller assembly on either side of said inner roller and said clearance channel;

a resilient member lining said arcuate interior wall of said arcuate passage which tends to bias said triple roller assembly into engagement with said outer wall.

25. An internally constrained vane rotary compressor in accordance with claim 1 wherein the linear distance between said end walls of each said arcuate passage being about equal to twice the distance between said axis of rotation of said rotor and said cylindrical axis of said stator.

26. The internally constrained vane rotary compressor in accordance with claim 1 wherein said stator circumferential interior wall ha a profile substantially matching the path formed by the distal tips of said vanes when rotated in said stator interior.

27. An internally constrained vane rotary compressor in accordance with claim 1 having at least one stator insert of a high temperature polymeric material affixed to said stator circumferential interior wall at a location of nearest proximity between said stator circumferential interior wall and said outer periphery of said rotor to minimize galling between said rotor and said circumferential interior wall in this region.

28. An internally constrained vane rotary compressor in accordance with claim 1 wherein said at least one aperture in said carrier is sufficiently small to prevent tangential motion of its respective vane relative to said carrier.

29. The apparatus of claim 28 in which said pin means on each said vane engaging its adjacent arcuate passage comprises a multiple roller assembly comprising at least two rollers rotatably mounted about a common axle, said axle being secured to and extending between said vane tongues, such that at least one roller will contact said arcuate outer wall to effectively constrain the vane from outward radial motion, while inward radial motion is constrained by at least one other roller contacting said arcuate interior wall.

30. An internally constrained vane rotary compressor comprising:

a stator having a hollow interior, circumferential interior wall, two end walls, and two openings through said circumferential interior wall defining an inlet to and an outlet from said stator interior;

a rotatable rotor having a hollow interior, said rotor eccentrically mounted within said stator such that the axis of rotation of said rotor is parallel to and offset from the axis of said stator;

a rotatable drive shaft passing through one of said end walls of said stator and projecting into said stator interior, said rotor affixed to said drive shaft for rotation therewith;

a fixed carrier shaft extending from one of said end walls towards said stator interior such that the cylindrical axis of said carrier shaft coincides with said axis of said stator;

a carrier ring residing within said rotor interior, said carrier being freely rotatable about said carrier shaft; and a plurality of vanes radially slideable within said rotor, said vanes hingedly connected to said carrier, whereby upon rotation of said rotor, said carrier constrains and guides said vanes such hat their distal ends come close to, but do not engage the surface of said circumferential interior wall of said stator;

said hinged connection between one of said vanes and said carrier being pinned so as to allow rotation of the vane about the pin axis, but so as to prevent tangential motion of the vane relative to the carrier;

the hinged connection between the remaining vanes and said carrier being defined by an arcuate passage extending through said carrier for each said remaining vane; and a means of connection between each said remaining vane and its adjacent arcuate passage allowing a degree of tangential motion in the arcuate passage while effectively preventing radial movement of the vane outward from the carrier center of rotation;

said means on each said vane engaging its adjacent arcuate passage comprising a triple roller assembly comprising at least two rollers rotatably mounted about a common axle, said axle being secured to said vane; said arcuate passage comprising an arcuate interior wall and an arcuate outer wall, such hat at least one roller will contact said arcuate outer wall to effectively constrain the vane from outward radial motion, while inward radial motion is constrained by at least one other roller contacting said arcuate internal wall;

a resilient member lining said arcuate interior wall of said arcuate passage which tends to bias said triple roller assembly into engagement with said outer wall.

31. An internally constrained vane rotary compressor in accordance with claim 30, wherein said carrier contains an annular, continuous channel formed on one side of said carrier, said annular channel having a center point coinciding with said axis of rotation of said carrier, said annular channel formed such that the interior wall of said annular channel nearest to said carrier axis of rotation coincides at least in part with each said arcuate interior wall of said arcuate passages.

32. An internally constrained vane rotary compressor in accordance with claim 31, wherein said annular channel formed on one side of said carrier has an exterior wall, located furthest from said carrier axis of rotation, also coinciding at least in part with each said arcuate outer wall of said arcuate passages.

33. An internally constrained vane rotary compressor in accordance with claim 32, wherein said carrier contains at least one O-ring residing along said interior wall of said annular channel, said O-ring comprising said resilient member.

34. The apparatus of claim 28 in which said pin means on each said vane engaging its adjacent arcuate passage comprises at least one roller.

35. An internally constrained vane rotary compressor in accordance with claim 34, comprising:

an annular continuous channel formed on one side of said carrier, said annular channel having a center point coinciding with said axis of rotation of said carrier, said annular channel formed such that the interior wall of said annular channel nearest to said carrier axis of rotation coincides at lest in part with each said arcuate interior wall of said arcuate passages.

36. An internally constrained vane rotary compressor in accordance with claim 35, wherein said annular channel formed on one side of said carrier has an exterior wall, located furthest from said carrier axis of rotation, also coinciding at least in part with each said arcuate outer wall of said arcuate passages.

37. An internally constrained vane rotary compressor in accordance with claim 36, wherein said carrier contains at least one O-ring residing along said interior wall of said annular channel.

38. An internally constrained vane rotary compressor in accordance with claim 37, wherein said interior wall of said annular channel formed in said carrier has a carrier passage O-ring depression extending radially inwards towards said axis of rotation of said carrier, said carrier passage O-ring depression providing seat area for said O-ring.

39. An internally constrained vane rotary compressor in accordance with claim 28, wherein:

each said arcuate passage comprises an arcuate interior wall positioned radially towards said carrier axis of rotation and an arcuate outer wall; and an annular, continuous channel formed on one side of said carrier, said annular channel having a center point coinciding with said axis of rotation of said carrier, said annular channel formed such that the interior wall of said annular channel nearest to said carrier axis of rotation coincides at least in part with each said arcuate interior wall of said arcuate passages.

40. The internally constrained vane rotary compressor in accordance with claim 39, wherein said annular channel formed on one side of said carrier has an exterior wall, located furthest from said carrier axis of rotation, also coinciding at least in part with each said arcuate outer wall of said arcuate passages.

41. The internally constrained vane rotary compressor in accordance with claim 40, wherein said carrier includes an annular, continuous channel formed on the other side of said carrier, said second annular channel having a center point coinciding with said axis of rotation of said carrier, said second annular channel formed such that the exterior wall of said second annular channel, located furthest from said carrier axis of rotation, also coincides at least in part with each said arcuate outer wall of said arcuate passages.

42. An internally constrained vane rotary compressor in accordance with claim 28, wherein said stator circumferential interior wall has a profile substantially matching the path formed by the distal tips of said vanes when rotated in said stator interior, said path defined by coordinates (X, Y):

$$X=[(r\cdot\cos(a)-X_r)(1+V/((r\cdot\cos(a)-X_r)^2+(r\cdot\sin(a)-Y_r)^2)^{\frac{1}{2}}]+(X_r-X_c)$$

$$Y=[(r\cdot\sin(a)-Y_r)(1+V/((r\cdot\cos(a)-X_r)^2+(r\cdot\sin(a)-{}_r)^2)^{\frac{1}{2}})]+(Y_r-Y_c)$$

where r = the radial distance from said cylindrical axis of said carrier shaft to the cylindrical axis of said vane pin;

v = the linear distance from said cylindrical axis of said vane pin to said distal tip of said vane;

a = the angle of rotation of said vane pin expressed from 0°-360°;

$X_r$, $Y_r$ = the cartesian coordinates of said axis of rotation of said rotor;

$X_c$, $Y_c$ = the cartesian coordinates of said cylindrical axis of said carrier shaft; and X,Y = the cartesian coordinates of said distal tip of said vane, at said angle of rotation a.

43. The apparatus of claim 42 in which said pin means on each said vane engaging its adjacent arcuate passage comprises at least one roller.

44. The apparatus of claim 43 in which said pin means on each said vane engaging its adjacent arcuate passage comprises a multiple roller assembly comprising at least two rollers rotatably mounted about a common axle extending between a and joined to said tongues, said arcuate interior wall being engaged by at least one of said rollers of said multiple roller assembly, said arcuate outer wall including a central clearance channel providing clearance for said inner roller and being engaged by at least one other of said rollers of said roller assembly.

45. A method for increasing the operation efficiency in an internally constrained vane rotary compressor comprising:

a stator having a hollow interior, circumferential interior wall, two end walls, and two openings through said circumferential interior wall defining an inlet to and an outlet from said stator interior;

a rotatable rotor having a hollow interior, said rotor eccentrically mounted within said stator such that the axis of rotation of said rotor is parallel and offset from the cylindrical axis of said stator;

a rotatable drive shaft passing through one of said end walls of said stator and projecting into said stator interior, said rotor affixed to said drive shaft for rotation therewith; and a plurality of vanes radially slideable within said rotor;

said method comprising;

employing a fixed carrier shaft extending from one of said end walls towards said stator interior such that the cylindrical axis of said carrier shaft coincides with said cylindrical axis of said stator;

mounting a rotatable carrier ring on said carrier shaft and within said rotor interior;

constraining and guiding said plurality of vanes at said rotor interior by hingedly attaching said vanes to said carrier ring such that their distal ends come close to but do not engage the surface of said circumferential interior wall of said stator, each of said vanes including a pair of tongues embracing either side of said carrier and means serving as a pin extending between said tongues and through an aperture in said carrier, there being an aperture in said carrier for each said vane and said vane pin; at least one of said apertures being sufficiently small relative to its respective one of said pins that rotation of said rotor and said vanes causes said carrier to rotate with said rotor, the engagement of said pin means and said at least one aperture also preventing radial outward movement of said vane; at least each of the remainder of said apertures comprising an arcuate passage with an arcuate interior wall positioned radially towards said carrier axis of rotation and an arcuate outer wall spaced outwardly therefrom, said interior and exterior arcuate walls being joined at their ends by arcuate passage end walls, the distance between said end walls being sufficiently short that said arcuate passages do not extend continuously from one passage to the next adjacent passage, and being sufficiently long to allow a degree of tangential motion in the arcuate passage, while said outer arcuate passage wall effectively prevents radial movement of the vane outward from the carrier center of rotation; and forming said stator circumferential interior wall to substantially match the path the distal tips of said vanes trace within said stator interior upon rotation of said rotor.

46. A method for increasing the operating efficiency in an internally constrained vane rotary compressor in accordance with claim 45, wherein said pin means for each of said vanes in an arcuate passage is a triple roller assembly comprising:

a first outer roller contacting said arcuate outer wall of said carrier ring arcuate passage;

an inner roller;

a second outer roller contacting said arcuate outer wall of said carrier ring arcuate passage; and an axle extending between said vane tongues, and through said first outer roller, said inner roller, and said second outer roller.

47. A method for increasing the operating efficiency in an internally constrained vane rotary compressor in accordance with claim 46, wherein said stator circumferential interior wall is formed to substantially match said path of said distal tips of rotating vanes, said path defined by coordinates (X, Y):

$$X=[(r\cdot\cos(a)-X_r)(1+V/((r\cdot\cos(a)-X_r)^2+(r\cdot\sin(a)-Y_r)^2)^{\frac{1}{2}}]+(X_r-X_c)$$

$$Y=[(r\cdot\sin(a)-Y_r)(1+V/((r\cdot\cos(a)-X_r)^2+(r\cdot\sin(a)-{}_r)^2)^{\frac{1}{2}})]+(Y_r-Y_c)$$

where r=the radial distance from said cylindrical axis of said carrier shaft to the cylindrical axis of said vane pin;

v=the linear distance from said cylindrical axis of said vane pin to said distal tip of said vane;

a=the angle of rotation of said vane pin expressed from 0°-360°;

$X_r$, $Y_r$=the cartesian coordinates of said axis of rotation of said rotor;

$X_c$, $Y_c$=the cartesian coordinates of said cylindrical axis of said carrier shaft; and X,Y=the cartesian coordinates of said distal tip of said vane, at said angle of rotation a.

48. A method for increasing the operating efficiency in an internally constrained vane rotary compressor in accordance with claim 45 wherein said step of hingedly connecting one of said vanes and said carrier comprises making said at least one aperture sufficiently small so as to prevent tangential motion of its associated vane relative to said carrier.

49. A method for increasing the operating efficiency in an internally constrained vane rotary compressor in accordance with claim 48, wherein said pin means for each of said vanes in an arcuate passage is a triple roller assembly comprising:

a first outer roller contacting said arcuate outer wall of said carrier ring arcuate passage;

an inner roller;

a second outer roller contacting said arcuate outer wall of said carrier ring arcuate passage; and an axle extending between said vane tongues, and through said first outer roller, said inner roller, and said second outer roller.

50. A method for increasing the operating efficiency in an internally constrained vane rotary compressor in accordance with claim 49 wherein said stator circumferential interior wall is formed to substantially match said path of said distal tips of rotating vanes, said path defined by coordinates (X, Y):

$$X=[(r\cdot\cos(a)-X_r)(1+V/((r\cdot\cos(a)-X_r)^2+(r\cdot\sin(a)-Y_r)^2)^{\frac{1}{2}}]+(X_r-X_c)$$

$$Y=[(r\cdot\sin(a)-Y_r)(1+V/((r\cdot\cos(a)-X_r)^2+(r\cdot\sin(a)-{}_r)^2)^{\frac{1}{2}})]+(Y_r-Y_c)$$

where r=the radial distance from said cylindrical axis of said carrier shaft to the cylindrical axis of said vane pin;

v=the linear distance from said cylindrical axis of said vane pin to said distal tip of said vane;

a=the angle of rotation of said vane pin expressed from 0°-360°;

$X_r$, $Y_r$=the cartesian coordinates of said axis of rotation of said rotor;

$X_c$, $Y_c$=the cartesian coordinates of said cylindrical axis of said carrier shaft; and X,Y=the cartesian coordinates of said distal tip of said vane, at said angle of rotation a.

51. The internally constrained vane rotary compressor of claim 39 in which said rotor is also rotatably supported on a bearing assembly mounted on said other of said end walls of said stator.

52. The internally constrained vane rotary compressor of claim 34 in which said rotor is also rotatably supported on a bearing assembly mounted on said other of said end walls of said stator.

53. The internally constrained vane rotary compressor of claim 29 in which said rotor is also rotatably supported on a bearing assembly mounted on said other of said end walls of said stator.

54. The internally constrained vane rotary compressor of claim 28 in which said rotor is also rotatably supported on a bearing assembly mounted on said other of said end walls of said stator.

55. The internally constrained vane rotary compressor of claim 23 in which said rotor is also rotatably supported on a bearing assembly mounted on said other of said end walls of said stator.

56. The internally constrained vane rotary compressor of claim 12 in which said rotor is also rotatably supported on a bearing assembly mounted on said other of said end walls of said stator.

57. The internally constrained vane rotary compressor of claim 11 in which said rotor is also rotatably supported on a bearing assembly mounted on said other of said end walls of said stator.

58. The internally constrained vane rotary compressor of claim 10 in which said rotor is also rotatably supported on a bearing assembly mounted on said other of said end walls of said stator.

59. The internally constrained vane rotary compressor of claim 5 in which said rotor is also rotatably supported on a bearing assembly mounted on said other of said end walls of said stator.

60. The internally constrained vane rotary compressor of claim 4 in which said rotor is also rotatably supported on a bearing assembly mounted on said other of said end walls of said stator.

61. The internally constrained vane rotary compressor of claim 3 in which said rotor is also rotatably supported on a bearing assembly mounted on said other of said end walls of said stator.

62. The internally constrained vane rotary compressor of claim 2 in which said rotor is also rotatably supported on a bearing assembly mounted on said other of said end walls of said stator.

63. The internally constrained vane rotary compressor of claim 1 in which said rotor is also rotatably supported on a bearing assembly mounted on said other of said end walls of said stator.

* * * * *

UNITED STATES PATENT AND TRADEMARK OFFICE

CERTIFICATE OF CORRECTION

PATENT NO. : 5,181,843

DATED : January 26, 1993

INVENTOR(S) : Edward W. Hekman et al.

It is certified that error appears in the above-identified patent and that said Letters Patent is hereby corrected as shown below:

Column 6, Line 4:

"stator 0" should be --stator 10--.

Column 9, Line 7, Claim 1:

"contraining" should be --constrained--.

Column 10, Line 60, Claim 11:

"lest" should be --least--.

Column 11, Line 29, Claim 16:

"lest" should be --least--.

Column 11, Line 66, Claim 21:

"$2)^{\frac{1}{2}})]$" should be --$^{2})^{\frac{1}{2}})]$--.

Column 12, Line 56, Claim 24:

"hat" should be --that--.

Column 13, Line 55, Claim 26:

"ha" should be --has--.

Column 14, Line 37, Claim 30:

"hat" should be --that--.

UNITED STATES PATENT AND TRADEMARK OFFICE

CERTIFICATE OF CORRECTION

PATENT NO. : 5,181,843

DATED : January 26, 1993

INVENTOR(S) : Edward W. Hekman et al.

It is certified that error appears in the above-identified patent and that said Letters Patent is hereby corrected as shown below:

Column 14, Line 61, Claim 30:

"interior" should be --internal--.

Column 14, Line 61, Claim 30:

"hat" should be --that--.

Column 15, Line 1, Claim 30:

before "outer" insert --arcuate--.

Column 15, Line 33, Claim 35:

"lest" should be --least--.

Column 16, Line 22, Claim 42:

after "½" insert --)--.

Column 16, Line 25, Claim 42:

after "(a)-" insert --Y--.

Column 16, Line 47, Claim 44:

after "between" delete "a".

Column 16, Line 54, Claim 45:

"operation" should be --operating--.

UNITED STATES PATENT AND TRADEMARK OFFICE

CERTIFICATE OF CORRECTION

PATENT NO. : 5,181,843

DATED : January 26, 1993

INVENTOR(S) : Edward W. Hekman et al.

It is certified that error appears in the above-identified patent and that said Letters Patent is hereby corrected as shown below:

Column 17, Line 66, Claim 47:

after "½" insert --)--.

Column 17, Line 68, Claim 47:

after "(a)-" insert --Y--.

Column 18, Line 44, Claim 50:

"$^{2})^{\frac{1}{2}}$ ]" should be --$^{2})^{\frac{1}{2}}$)]--.

Column 18, Line 47, Claim 50:

after "(a)-" insert --Y--.

Signed and Sealed this

Twelfth Day of April, 1994

Bruce Lehman

*Attest:*

BRUCE LEHMAN

*Commissioner of Patents and Trademarks*

*Attesting Officer*